US008777025B1

(12) United States Patent
Buckleitner et al.

(10) Patent No.: US 8,777,025 B1
(45) Date of Patent: Jul. 15, 2014

(54) MODULAR HANGING SOLUTIONS FOR A HOUSEHOLD APPLIANCE

(75) Inventors: Thomas H. Buckleitner, Stevensville, MI (US); Jayaprakash Kannappan, Tamil Nadu (IN); Travis M. Perkins, Granger (IN); Arunprasath Sridharan, Tamil Nadu (IN); Daniel E. Teich, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 92 days.

(21) Appl. No.: 13/212,261

(22) Filed: Aug. 18, 2011

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47F 7/00*** | (2006.01) |
| ***A47G 25/06*** | (2006.01) |
| ***D06F 57/12*** | (2006.01) |
| ***A47F 5/04*** | (2006.01) |
| ***A47B 91/02*** | (2006.01) |

(52) U.S. Cl.
CPC ..... *A47G 25/0664* (2013.01); *D06F 57/122* (2013.01); *A47F 5/04* (2013.01); *A47B 91/02* (2013.01)
USPC ..... 211/196; 211/13.1; 211/85.3; 211/205; 248/188.2; 34/239

(58) Field of Classification Search
CPC ..... A47G 25/0664; A47G 25/0671; A47G 25/0685; A47G 25/0692; A47G 25/02; A47F 5/04; D06F 57/02; D06F 57/04; D06F 57/08; D06F 57/12; D06F 57/122; D06F 57/127; F16M 7/00; F16M 11/32; F16M 7/1463; F16M 13/02; A47B 91/02; A47B 91/022; A47B 91/024; A47B 91/026; A47B 91/028; A47B 91/16; A47B 91/00; A47B 61/003; A47B 61/02; A47B 25/06; A47C 7/002; G09F 7/18; G09F 7/20
USPC ..... 211/196, 205, DIG. 1, 197, 1.3, 94.03, 211/96–102, 13.1, 85.3, 183, 182; 68/240; 34/184, 186, 192, 239, 237, 240; 312/140.4, 280, 351.1; 248/511, 523, 248/539, 537, 534, 518, 309.1, 176.1, 248/206.5, 309.4, 201, 205.1, 310, 315, 248/218.4, 188.2, 188.5, 188.8
See application file for complete search history.

(56) References Cited

U.S. PATENT DOCUMENTS

| | | | | | |
|---|---|---|---|---|---|
| 632,999 | A | | 9/1899 | Grant | |
| 1,043,950 | A | * | 11/1912 | Martin | 108/5 |
| 1,188,921 | A | * | 6/1916 | Finkelstein | 223/90 |
| 2,156,184 | A | * | 4/1939 | Koski | 34/621 |
| 2,293,275 | A | | 8/1942 | Boltz | |
| 2,455,213 | A | * | 11/1948 | Bell | 211/103 |
| 2,515,828 | A | * | 7/1950 | Roper | 34/442 |
| 2,578,826 | A | * | 12/1951 | Mrofka | 108/116 |
| 2,654,484 | A | * | 10/1953 | Win et al. | 211/1.3 |
| 2,680,326 | A | * | 6/1954 | Sultan | 248/188.4 |

(Continued)

FOREIGN PATENT DOCUMENTS

| | | |
|---|---|---|
| DE | 4105112 A1 | 8/1992 |
| GB | 1160274 | 8/1969 |

(Continued)

*Primary Examiner* — Jennifer E Novosad

(57) ABSTRACT

A laundry hanging solution comprising an expansion assembly, a post assembly, and a hanging rod assembly.

17 Claims, 6 Drawing Sheets

(56) References Cited

U.S. PATENT DOCUMENTS

| | | | | | |
|---|---|---|---|---|---|
| 2,854,148 | A | * | 9/1958 | Mattos et al. | 108/28 |
| 2,937,768 | A | * | 5/1960 | Davis | 211/175 |
| 2,983,050 | A | | 5/1961 | Alaback | |
| 2,988,310 | A | * | 6/1961 | Wright | 248/511 |
| 3,023,912 | A | * | 3/1962 | Sebastian | 211/196 |
| 3,134,978 | A | * | 5/1964 | Arvay, Jr. | 343/709 |
| 3,302,305 | A | | 2/1967 | Little | |
| 3,313,425 | A | * | 4/1967 | Injeski | 211/204 |
| 3,363,777 | A | * | 1/1968 | Cooper | 211/85.3 |
| 3,399,783 | A | * | 9/1968 | Injeski | 211/103 |
| 3,784,021 | A | * | 1/1974 | Mark | 211/43 |
| 3,926,315 | A | | 12/1975 | Bernard | |
| 4,086,709 | A | | 5/1978 | Jackson | |
| 4,094,414 | A | | 6/1978 | Thiot et al. | |
| 4,265,029 | A | * | 5/1981 | Jenkins | 34/266 |
| 4,312,452 | A | * | 1/1982 | Waier | 211/23 |
| 4,687,168 | A | * | 8/1987 | Rupp | 248/539 |
| D301,094 | S | * | 5/1989 | Muxlow | D6/411 |
| 4,856,206 | A | * | 8/1989 | Klein | 34/619 |
| 4,923,157 | A | * | 5/1990 | Belamiza | 248/188.2 |
| 4,961,388 | A | * | 10/1990 | Simpson | 108/42 |
| 5,169,219 | A | * | 12/1992 | Obbink | 312/245 |
| 5,176,437 | A | * | 1/1993 | Remington | 312/351.1 |
| 5,253,378 | A | * | 10/1993 | Jung, Jr. | 8/149.1 |
| 5,354,031 | A | * | 10/1994 | Bilotti | 248/519 |
| 5,437,106 | A | | 8/1995 | Pardoe | |
| 5,460,305 | A | * | 10/1995 | Ahearn | 224/562 |
| 5,470,037 | A | * | 11/1995 | Willis | 248/125.9 |
| D414,625 | S | * | 10/1999 | Stelmarski | D6/411 |
| 6,374,947 | B1 | * | 4/2002 | Nurkiewicz | 182/201 |
| 6,386,378 | B1 | * | 5/2002 | Scharing | 211/86.01 |
| 6,471,076 | B1 | * | 10/2002 | Chen | 211/70.6 |
| 6,516,959 | B1 | * | 2/2003 | Gribbins et al. | 211/205 |
| 6,604,473 | B2 | * | 8/2003 | Felsenthal | 108/107 |
| 6,883,670 | B2 | * | 4/2005 | Moon | 211/74 |
| 6,889,878 | B2 | * | 5/2005 | Parsons | 224/200 |
| 6,986,177 | B2 | * | 1/2006 | Thaxton | 5/81.1 R |
| 7,587,917 | B2 | | 9/2009 | Gilboe et al. | |
| 7,789,369 | B2 | * | 9/2010 | Jahnz | 248/540 |
| 7,849,717 | B2 | | 12/2010 | Sunshine | |
| 8,016,135 | B2 | * | 9/2011 | Price et al. | 211/86.01 |
| 2002/0144961 | A1 | * | 10/2002 | McNab | 211/85.3 |
| 2003/0192848 | A1 | * | 10/2003 | Zidek | 211/205 |
| 2004/0099776 | A1 | * | 5/2004 | Dougal et al. | 248/206.5 |
| 2004/0178305 | A1 | * | 9/2004 | Avendano et al. | 248/188.2 |
| 2004/0188370 | A1 | * | 9/2004 | Nawrocki et al. | 211/204 |
| 2005/0184205 | A1 | * | 8/2005 | Fang et al. | 248/188.2 |
| 2006/0054576 | A1 | * | 3/2006 | Durham | 211/85.7 |
| 2006/0070968 | A1 | * | 4/2006 | Terhune et al. | 211/205 |
| 2006/0202095 | A1 | * | 9/2006 | Shao et al. | 248/188.2 |
| 2007/0151303 | A1 | | 7/2007 | Doyle et al. | |
| 2007/0151306 | A1 | | 7/2007 | Gilboe et al. | |
| 2008/0166330 | A1 | * | 7/2008 | Petyaev et al. | 424/93.44 |
| 2008/0217364 | A1 | | 9/2008 | Fong | |
| 2008/0302941 | A1 | * | 12/2008 | Matthews | 248/523 |
| 2010/0064543 | A1 | | 3/2010 | Helot | |
| 2010/0163696 | A1 | * | 7/2010 | Briggs et al. | 248/206.5 |
| 2012/0241568 | A1 | * | 9/2012 | Christian et al. | 248/188.3 |

FOREIGN PATENT DOCUMENTS

| | | | |
|---|---|---|---|
| GB | 2472490 | A | 2/2011 |
| JP | 4084998 | A | 3/1992 |
| JP | 7213792 | A | 8/1995 |
| JP | 8024490 | A | 1/1996 |
| JP | 11057278 | A | 3/1999 |
| JP | 11156086 | A | 6/1999 |
| KR | 20010011539 | A | 2/2001 |

* cited by examiner

MODULAR HANGING SOLUTIONS FOR A HOUSEHOLD APPLIANCE

BACKGROUND OF THE INVENTION

Household appliances, such as a washing machine or clothes dryer, may treat laundry or other articles according to a cycle of operation. Sometimes a user may find it convenient to treat the laundry outside the household appliance to complete the treatment, or to temporarily store the laundry, such as by hanging, from the household appliance, after a cycle of operation.

SUMMARY OF THE INVENTION

The invention relates to a laundry hanging solution for a household appliance having an expansion assembly expandable between a first configuration where a portion of the expansion assembly may be inserted between the lower edge of the appliance and the surface, and a second configuration, where the portion applies pressure to the lower edge and the surface to effectively couple the expansion assembly to the appliance; a post assembly extending upwardly from the expansion assembly and having an upper portion extending above a top of the cabinet; and a hanging rod assembly extending away from the upper portion of the post assembly.

DESCRIPTION OF EMBODIMENTS OF THE INVENTION

Figure 1:
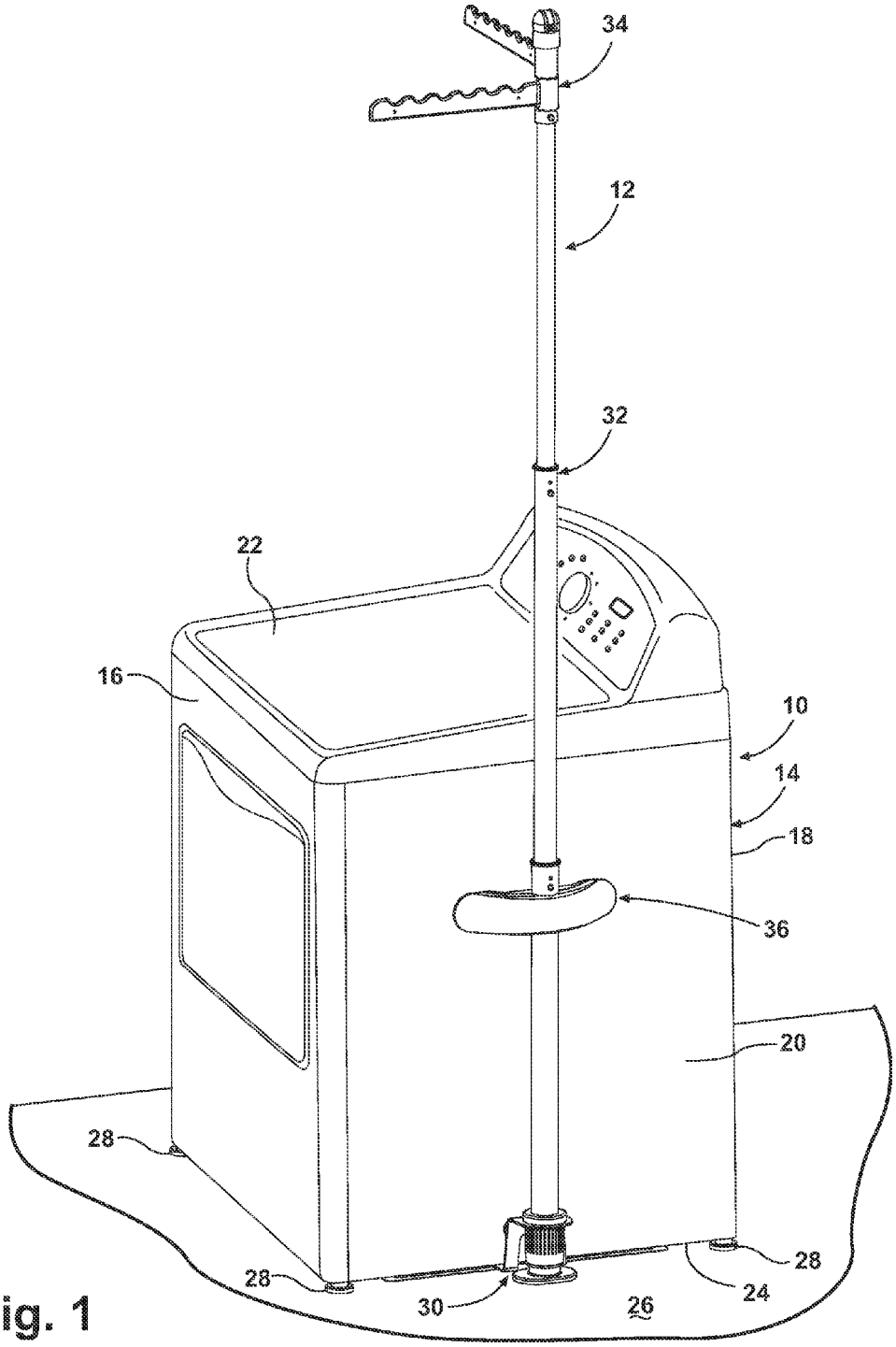
FIG. 1 is a schematic perspective view of a household appliance with a hanging solution coupled to the household appliance according to one embodiment of the invention.

FIG. 1 illustrates a household appliance 10 with a hanging solution 12 according to one embodiment of the invention. The household appliance 10 may be any household appliance that treats laundry articles such as clothing or fabrics. Non-limiting examples of the household appliance may include a top loading/vertical axis washing machine; a front loading/horizontal washing machine; a combination washing machine and dryer; a clothes dryer; an extractor; a non-aqueous washing apparatus; a revitalizing machine; and a tumbling or stationary refreshing/revitalizing machine. The household appliance 10 in the form of a washing machine described herein shares many features of a traditional automatic washing machine, which will not be described in detail except as necessary for a complete understanding of the invention.

As illustrated in FIG. 1, the household appliance 10 may include a cabinet 14, which may be a housing having a chassis and/or a frame to which decorative panels may or may not be mounted. The cabinet 14 may be defined by a front wall 16, a rear wall 18, and a pair of side walls 20, and a top wall 22. The cabinet 14 may include a lower edge 24 that may be spaced by a predetermined gap above a surface 26 of the floor on which the household appliance 10 is located. The household appliance 10 may include feet 28, which may be adjustable, that extend from the lower edge 24 of the cabinet 14 to set and maintain the gap between the cabinet 14 and the surface 26. For example, four feet 28 may extend from the corner of the lower edge 24 of the cabinet 14 to the surface 26.

As illustrated, the hanging solution 12 is operably coupled to the side wall 20 of the household appliance 10. However, the hanging solution 12 may be coupled to another portion of the household appliance 10 such as the front wall. The hanging solution 12 may include an expansion assembly 30, a post assembly 32, a hanging rod assembly 34, and an attachment assembly 36, which would be described in detail.

Figure 2:
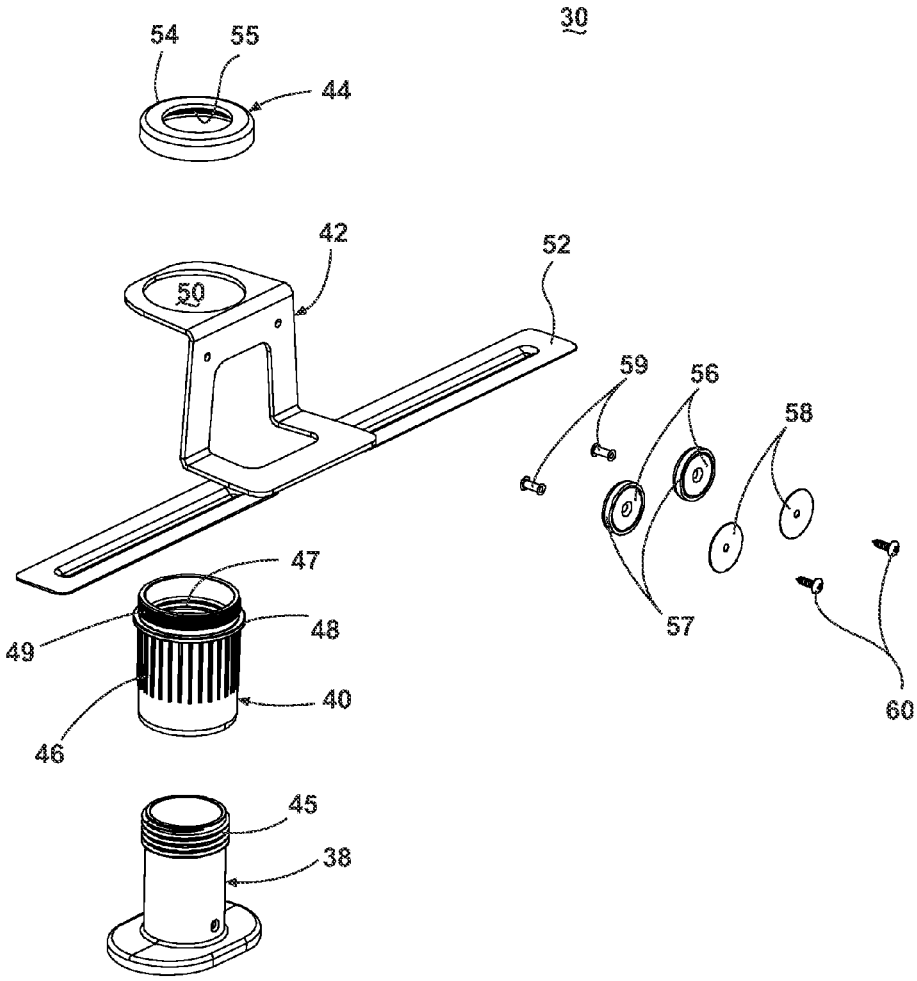
FIG. 2 is an exploded view of an expansion assembly of FIG. 1.

FIG. 2 is an exploded view of the expansion assembly 30 illustrated in FIG. 1. The expansion assembly 30 may include a foot 38, a collar 40, a bracket 42 and a cap 44. A portion of the foot 38 may include a tube, with thread 45 formed on the upper, outer surface of the foot 38.

The collar 40 may be also in the form of a tube, with a plurality of ribs 46, to aid in gripping, on the exterior of the tube. The collar 40 may include thread 47 formed on the inner wall of the collar 40, which may be complementary to the thread 45 formed on outer surface of the foot 38 to provide for threading the collar 40 onto the foot 38. The collar 40 may have additional thread 49 on the external, top portion of the collar 40. A stop rib 48 may be formed on the top, exterior portion of the collar 40 along a circumference of the collar 40.

The bracket 42 has a Z-like cross section having an upper end that may have an opening 50 that is sized to receive the upper end of the collar 40. The lower end of the bracket 42 may include a bearing plate 52 defining the length of the bracket 42. The bearing plate 52 may be long enough to substantially cover the width of the lower edge 24 of the cabinet 14.

The cap 44 may have a ring 54, and thread 55 on the internal wall of the cap 44. The thread 55 formed on the cap 44 may be complementary to the thread 49 formed on the external surface of the collar 40.

At least one magnet 56, covered by a rubber pad 58, or other sheets or films including at least one polymer material, may be received by the magnet housing 57. The magnet 56 may be coupled to a vertical portion of the bracket 42 by rivet 59 and the rubber pad 58 may be coupled to the magnet 56 by screw 60 while other coupling means such as bolt, nut, or washer may be employed in coupling.

The opening 50 of the bracket 42 may be positioned on top of the collar rib 48 and received by the top portion of the collar 40. Then the cap 44 may be positioned on the bracket opening 50, and may align with the top portion of the collar 40. The cap 44 may be rotated along the thread 49 formed on the upper, outer surface of the collar 40, with the bracket 42 in between the cap 44 and the foot 38. As a result the bracket 42 may be operably coupled to the collar 40 to maintain mechanical integrity.

The overall dimension of the collar 40 may be configured such that the foot 38 can be slid into the interior of the collar 40. The collar 40 may be coupled to the foot 38 by rotating the collar 40 along the thread 45 formed on the surface of the foot 38 in a predetermined direction. Once the collar 40 is coupled to the bracket 42, the relative vertical position of the bracket 42 with respect to the foot 38 may be determined by rotating the collar 40 to raise and lower the bracket 42 relative to the foot 38. In this manner, the bearing plate 52 can be moved relative to the foot 28 and brought into contact with the lower edge 24 of the cabinet 14 and apply an expansion force between the surface 26 of the floor and the lower edge 24 to secure the hanging solution 12 to the cabinet 14.

Figure 3:
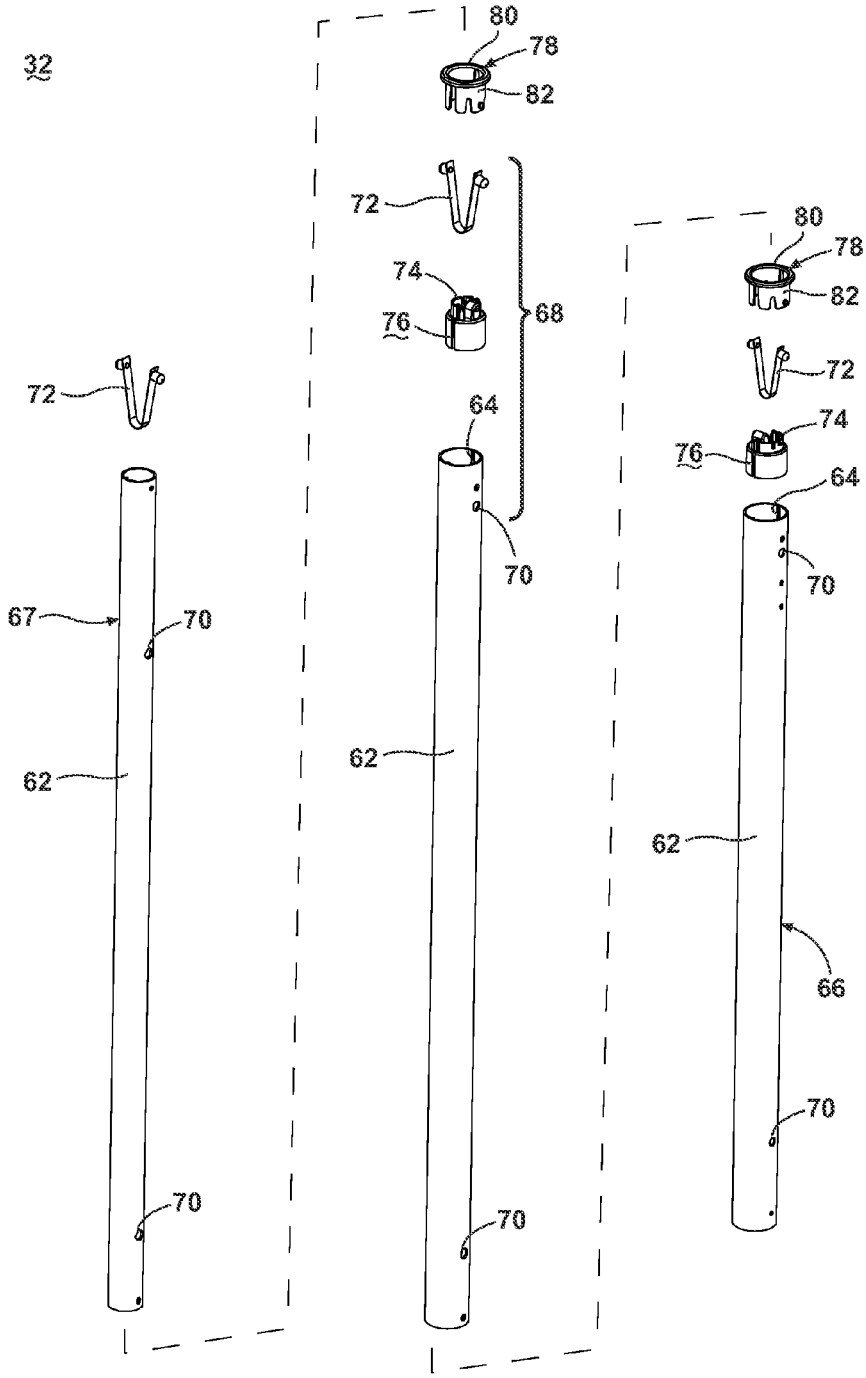
FIG. 3 is an exploded view of a post assembly of FIG. 1.

FIG. 3 is an exploded view of the post assembly 32 illustrated in FIG. 1. As illustrated, the post assembly 32 may include at least two telescoping posts 62, although more are possible. The post assembly 32 may have a lower portion 66 which may be coupled to the expansion assembly 30, and an upper portion 67 which may be coupled to the hanging rod assembly 34. Generally the telescoping post 62 may be in the form of a hollow cylinder while it may be noted other hollow shapes, such as ovals or rectangular tube, are also possible for the telescoping post 62. At least one key in the form of a rib 64 may be provided on the interior wall of the post 62 along the direction of the length of the post 62. It may be understood that the height of the post assembly 32 may be enough to extend above the top of the cabinet 14 of the home appliance.

The post assembly 32 may further include a lock assembly 68. The lock assembly 68 is illustrated as a spring-biased detent including at least one opening 70 formed on one of the at least two posts, while multiple openings may be formed on two posts as illustrated, and a spring finger 72, which may be positioned in the interior of the other of the at least two posts. The spring finger 72 may be comprised of metallic material such as steel and may be configured to be resilient to the applied force. The dimension of the end portion of V-shaped spring finger 72 may be configured to be received by the openings 70. The lock assembly 68 may also have a keyway 74 formed in the interior of the telescoping post 62, with the keyway 74 including at least one groove 76 formed in the keyway 74.

The post assembly 32 may further include a cover 78. The cover 78 may include a ring 80 coupled to a support 82. The diameter of ring 80 may be configured such that the cover 78 may be received by the telescoping post 62.

Any telescoping post 62 may be coupled to another telescoping post 62 by the lock assembly 68 to form a telescoping lock and a rotational lock. For example, the spring finger 72, which is positioned in the interior of the post 62, may be received within the opening 70 in the telescoping post 62. Then the telescoping post 62 may be slid into the other telescoping post 62 having complementary opening 70 until the spring finger 72 engages to the opening 70 in the other telescoping post 62. The spring finger 72 is then pushed outwardly due to its elastic spring force to form a telescoping lock.

The relative rotational position of the telescoping posts 62 is controlled by the cooperation of the key 64 and keyway 74. The keyway 74 which is positioned in the interior of the telescoping post 62 may be engaged to the key 64 formed in the other telescoping post 62 such that the keyway 74 receives the key 64. This engagement between the keyway 74 and the key 64 may prevent an unexpected radial rotation of the post 62 with respect to the other to form a rotational lock. The key 64 and keyway 74 also function to rotationally align the telescoping posts 62 to ensure axial alignment of the opening 70 and spring finger 72.

Figure 4:
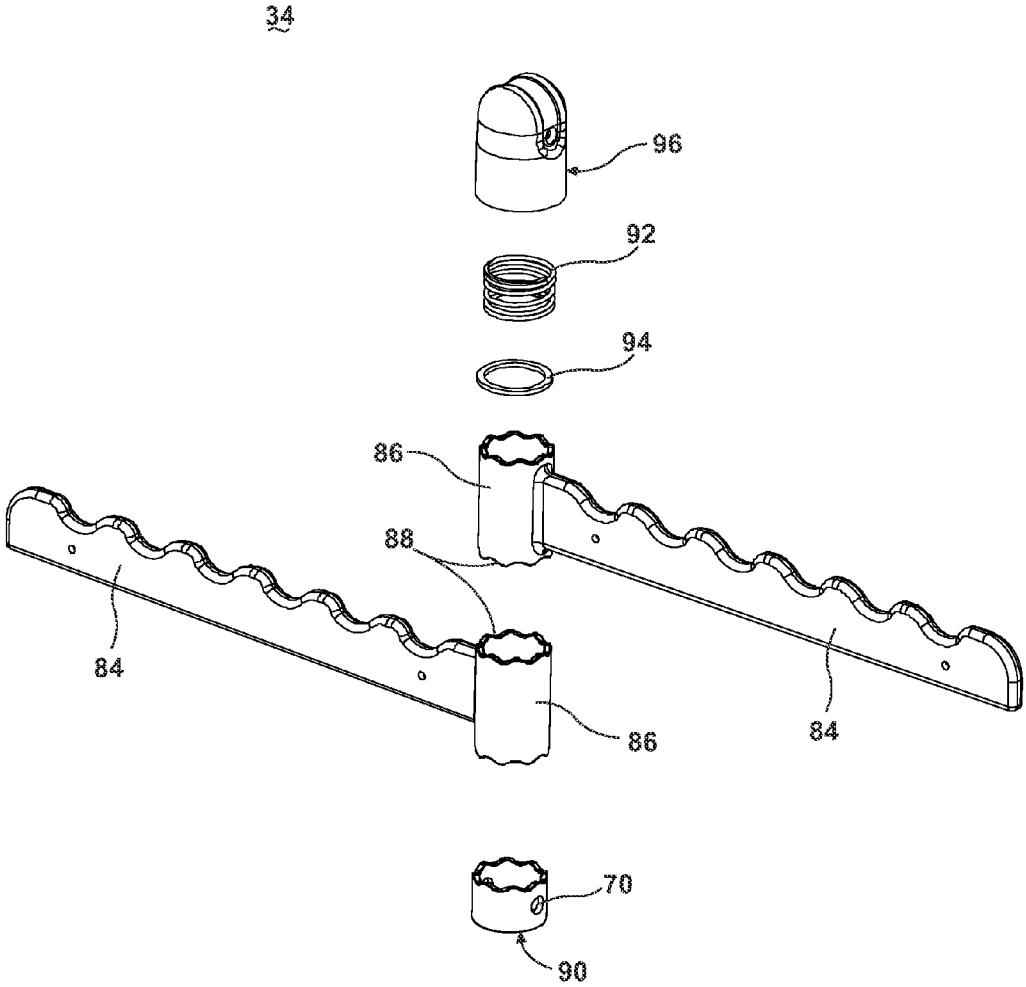
FIG. 4 is an exploded view of a hanging rod assembly of FIG. 1.

FIG. 4 is an exploded view of a hanging rod assembly 34 illustrated in FIG. 1. The hanging rod assembly 34 may include at least one arm 84 extending from the upper portion 67 of the post assembly 32. As illustrated, the shape of the arm 84 may include a predetermined number of valleys formed in the arm 84 to provide convenient locations for receiving hangers.

A rotatable mount 86 may be coupled to the arm 84 to form the hanging rod assembly 34. The rotatable mount 86 may have a cylinder with at least one of the top or bottom having an arm lock 88 or detent in the form castellation. For example, the rotatable mount 88 may be designed to include a predetermined numbers of ridges and valleys such as eight ridges and valleys. The inner diameter of the rotatable mount 88 may be configured to be complementary to that of the upper portion 67 of the post assembly 32. The arm 84 and the rotatable mount 86 may be separately manufactured and then coupled to each other to form the hanging rod assembly 34 while the arm and rotatable mount may be formed in one piece by, for example, injection molding.

A bottom collar 90 may abut the rotatable mount 86, with the top portion of the bottom collar 90 having a corrugated pattern that may be complementary to that of the rotatable mount 86. The bottom collar 90 may include at least one opening 70 on the side wall of the bottom collar 90. A compression spring 92 and a washer 94 may be positioned on the top of the rotatable mount 86. A cap 96 may overlie the spring 92 and the washer 94.

The bottom collar 90 may be received by the upper portion 67 of the post assembly 34 by sliding of the bottom collar 90. The at least one opening 70 formed in the bottom collar 90 may engage to the spring finger 72 to provide a telescoping lock of the bottom collar 90 in the vertical direction. Subsequently, at least one hanging rod assembly 34, in the form of the arm and rotatable mount, may be received by the upper portion 67 of the post assembly 34.

By coupling the cap 96 to the upper portion 67 by screw or the like, the compression spring 92 and the washer 94, sequentially positioned on top of the rotatable mount 86, may provide a predetermined amount of axially-oriented, compression force to the rotatable mount 86 in a downwardly vertical direction to limit the free rotational movement of the arm 84 and fix the position of the arm 84 with respect to the upper portion 67. The radial position of the arm 84 with respect to the upper portion 67 of the post assembly 34 may be modified by applying a force greater than the predetermined spring force, such as by lifting up one or more of the arms 84 to separate one of the castellated interfaces and then rotating the one or more of the arms 84 to the desired position.

Figure 5:
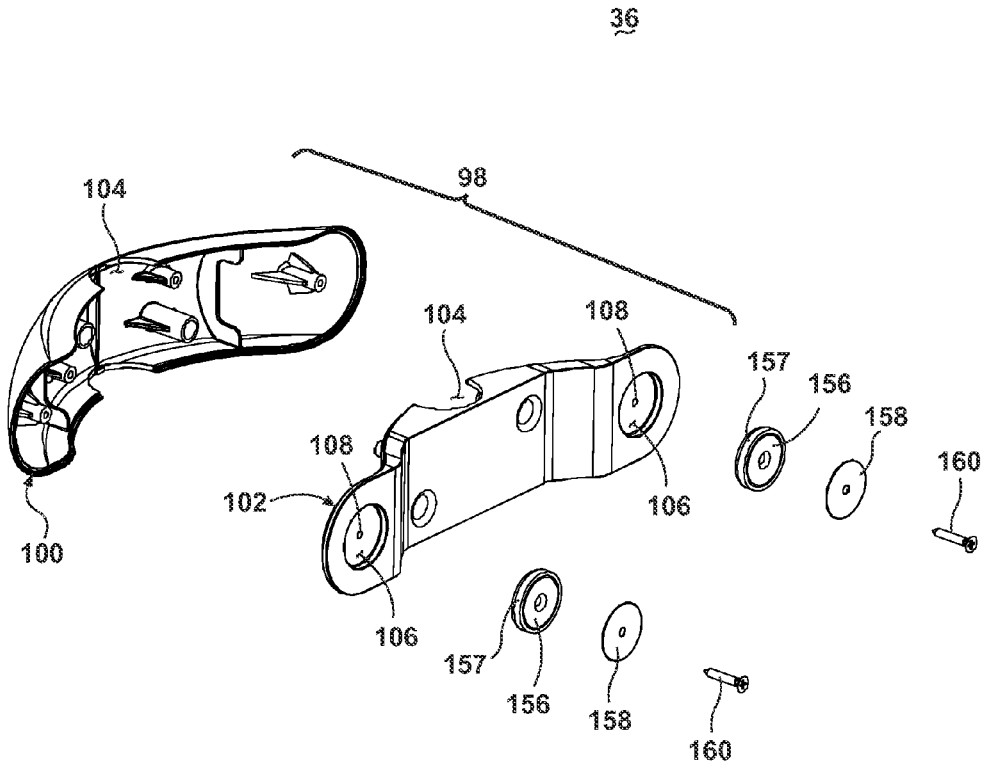
FIG. 5 is an exploded view of an attachment assembly of FIG. 1.

FIG. 5 is an exploded view of the attachment assembly 36 illustrated in FIG. 1. The attachment assembly 36 may include a holder 98. As illustrated, the holder 98 may include at least two supporting portions, front 100 and back 102, respectively, which may be operably coupled to each other to form the holder 98 while the holder 98 may comprise one piece. It may be understood that the holder 98 may have a recess 104 such that the post assembly 34 may be slid into the recess 104. The holder 98 may include two additional recesses 106 in one portion of the holder 98 while other recess configurations may be also possible. The recess 106 may be provided with an opening 108 in the bottom of the recess 106.

The magnet 156 may be coupled to the recess 106 of the holder 98. For example, a ring-shaped magnet 156 with a predetermined thickness may be positioned in the recess 106 of the holder 98 while the magnet may be in another geometrical shape. The magnet 156 may comprise a permanent magnet such as neodymium based (NdFeB) magnetic material while other metallic and/or ceramic magnets may be also used for the invention. A magnet housing 157 may be coupled to the recess 106 to hold the magnet 156 in the magnet housing 157. A rubber pad 158 may be coupled to the surface of the magnet 156 to eliminate the possibility of scratches. A screw 160 may pass through the magnet ring and the opening 108 formed in the recess 106 to couple the magnet 156 to the holder 98.

It may be noted that magnets 56 illustrated in FIG. 2 may comprise identical materials and structure as the magnets for the attachment assembly 36 while other materials and structures may be also possible. It may be also noted that other attachment assembly may be employed to couple the hanging solution 12 to the household appliance. For example, an adhesive assembly that may be easily attachable and detachable may be used.

Figure 6:
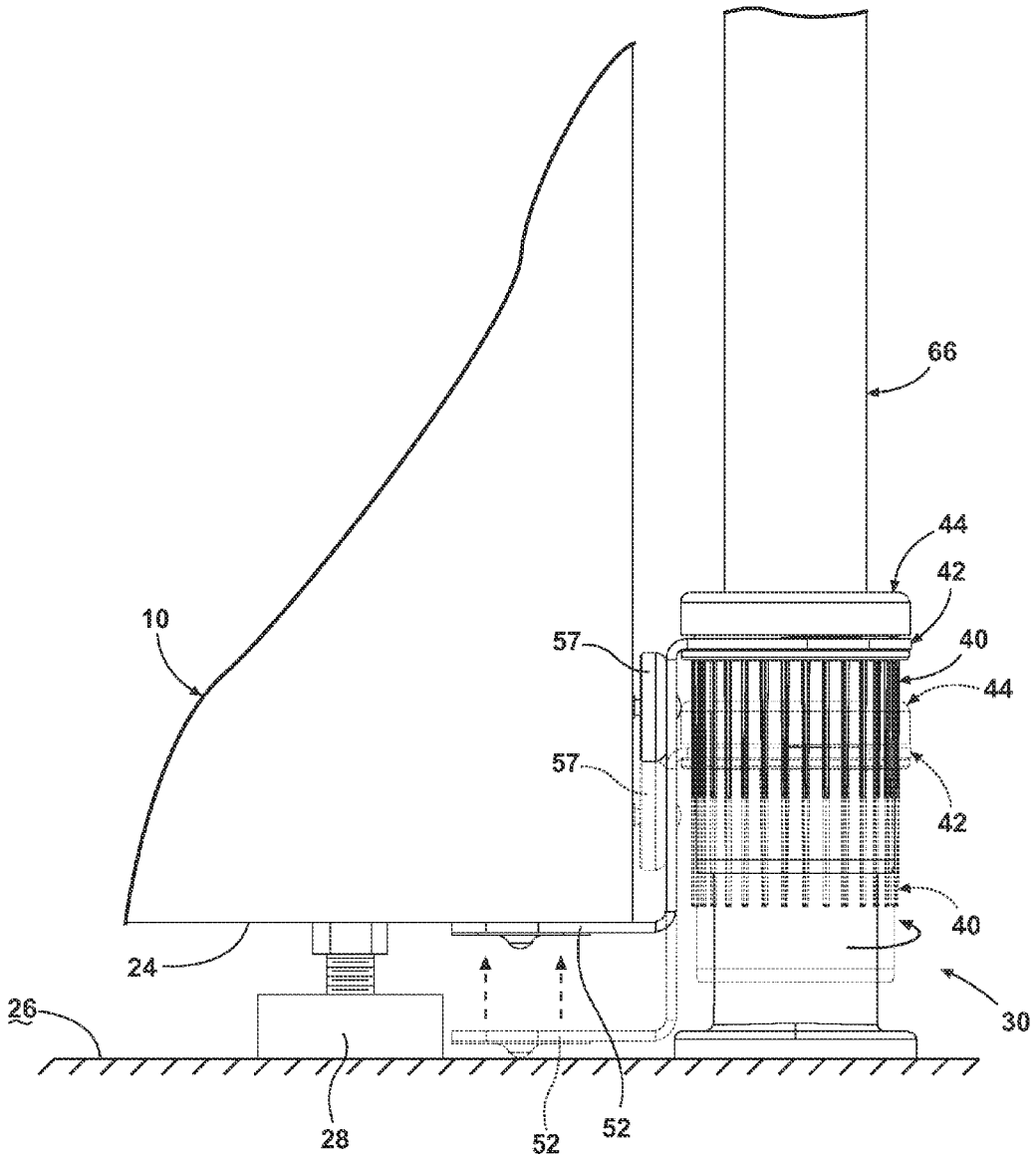
FIG. 6 is a vertical view of the expansion assembly of FIG. 1, illustrating the expansion from a first configuration (in phantom) where the expansion assembly may be inserted between a lower edge and a surface, to a second configuration where the expansion assembly may apply pressure to the lower edge and the surface.

FIG. 6 is a vertical view of the expansion assembly 30 of FIG. 1, and illustrates the expansion of the expansion assembly 30 from the first configuration (in phantom) where the expansion assembly 30 may be inserted between the lower edge 24 and the surface 26, to the second configuration where the expansion assembly may apply pressure to the lower edge 24 and the surface 26 to couple the expansion assembly 30 to the household appliance 10.

As illustrated, the mounting of the hanging solution 12 to the household appliance 10 may be effected by the expansion assembly 30 and the attachment assembly 36. It may be noted that the order of mounting of the hanging solution 12 to the household appliance 10 is not meant to limit the mounting method in any way as it is understood that the steps may proceed in a different logical order, additional or intervening steps may be included, or described steps may be divided into multiple steps, without detracting from the invention.

One way to typically couple the hanging solution 12 to the appliance 10 may include the following steps in the following order while other orders are also possible; the expansion assembly 30 may be coupled to the cabinet 14, and then the attachment assembly 36 may be coupled to the post assembly 32 having the hanging rod assembly 34. The post assembly 32 may be coupled to the expansion assembly 30 in the vertical direction. Finally the height of the attachment assembly 36 may be adjusted relative to the cabinet 14.

For the expansion assembly 30 to be coupled to the household appliance 10, the expansion assembly 30 may be positioned at a predetermined location along the side wall 20 of the cabinet 14. A portion, such as the bearing plate 52 defining the length of the bracket 42, of the expansion assembly 30 may be inserted between the lower edge 24 of the cabinet 14 of the household appliance 10 and the surface 26 to define a first configuration. When a user rotates the collar 40 of the expansion assembly 30 in a predetermined direction by a predetermined number of turns, one of the bracket 42 and the foot 38 may move in a vertical direction with respect to the other of the foot 38 and the bracket 42 until the bracket 42 touches the lower edge 24 of the cabinet 14. Further rotation of the collar 40 further in the predetermined direction would increase the distance between the bracket 40 and the foot 38, which would eventually apply pressure to the lower edge 24 and the surface 26 to define a second configuration. The magnets 56 that are attached to the bracket 42 may provide additionally effective coupling between the expansion assembly 30 and the side wall 20 of the cabinet 14.

The attachment assembly 36 may be coupled to the post assembly 32 by sliding the attachment assembly 36 along the post assembly 32.

The post assembly 32 may be operably coupled to the expansion assembly 30 by mounting the lower portion 66 of the post assembly 32 into the expansion assembly 30. For example, the lower portion 66 of the post assembly 32 may be received by the foot 38 along the vertical direction of the bracket 42.

The vertical position of the attachment assembly 36 relative to the post assembly 32 may be determined such that the attachment assembly 36 is coupled to the side wall 20 of the cabinet 14. The vertical location of the attachment assembly 36 may be further adjusted depending on other parameters such as the height or the surface profile of the side wall 20 to which the hanging solution is coupled.

The invention described herein uses the laundry hanging solution that can be easily attached to any home appliance to allow the user to hang multiple laundry articles, without requiring additional space. The laundry hanging solution can be easily de-mounted from the appliance, and can be easily disassembled for storage. Further the laundry hanging solution may have a structure that may be universally used in conjunction with all home appliances having a cabinet without requiring additional modification to the laundry hanging solution.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry hanging apparatus for a household appliance having a cabinet defining an interior with at least a top surface and a side surface, with the side surface having a lower edge that lies above a surface on which the appliance sits, the laundry hanging apparatus comprising:

an expansion assembly comprising a foot configured to abut the surface and a bracket configured to abut the lower edge, wherein the bracket is vertically moveable relative to the foot to adjust the bracket relative to the lower edge of the appliance;

a post assembly extending upwardly from the expansion assembly exteriorly of the side surface of the cabinet and having an upper portion extending above the top surface of the cabinet; and a hanging rod assembly extending away from the upper portion of the post assembly;

wherein the expansion assembly is expandable between a first configuration where the bracket is inserted between the lower edge of the appliance and the surface, and a second configuration, where the bracket applies pressure to the lower edge and the surface to effectively couple the expansion assembly to the appliance.

2. The laundry hanging apparatus of claim 1 wherein the post assembly mounts at a predetermined location along the length of the bracket to locate the post assembly at a predetermined location along the side surface of the cabinet.

3. The laundry hanging apparatus of claim 1 wherein the bracket is slidably mounted to the post assembly and the sliding of the bracket moves the expansion assembly between the first and second configurations.

4. The laundry hanging apparatus of claim 3 wherein the expansion assembly further comprises a collar mounted to the post assembly and coupled to the bracket such that rotation of the collar results in axial movement of the bracket along the post assembly to move the expansion assembly between the first and second configurations.

5. The laundry hanging apparatus of claim 4 further comprising a magnet assembly coupled to the post assembly and configured to magnetically couple to the cabinet at least when the expansion assembly is in the second configuration.

6. The laundry hanging apparatus of claim 1 wherein the post assembly comprises at least two telescoping posts, with one of the posts extending from the expansion assembly, and another of the posts defining the upper portion from which the hanging rod assembly extends.

7. The laundry hanging apparatus of claim 6 wherein the post assembly comprises a lock assembly for fixing at least one of rotational and telescoping positions of the at least two posts.

8. The laundry hanging apparatus of claim 7 wherein the lock assembly comprises an opening on one of the at least two posts and a spring finger on the other of the at least two posts, with the spring finger being received within the opening to form a telescoping lock.

9. The laundry hanging apparatus of claim 8 wherein the lock assembly comprises a keyway on one of the at least two posts and a key on the other of the at least two posts, with the key being received within the keyway to define a rotational lock.

10. The laundry hanging apparatus of claim 1 wherein the hanging rod assembly comprises at least one arm extending from the upper portion.

11. The laundry hanging apparatus of claim 10 wherein the hanging rod assembly further comprises a rotatable mount that rotatably couples the at least one arm to the upper portion of the post assembly to provide for the rotation of the at least one arm relative to the upper portion.

12. The laundry hanging apparatus of claim 11 wherein the rotatable mount comprises an arm lock for fixing the rotational position of the arm relative to the upper portion of the post assembly.

13. The laundry hanging apparatus of claim 12 wherein the arm lock comprises at least one detent for fixing the rotational position of the arm relative to the upper portion of the post assembly.

14. The laundry hanging apparatus of claim 1, wherein the lower edge is separated apart from the surface on which the appliance sits.

15. The laundry hanging apparatus of claim 1 further comprising a magnet assembly coupled to the post assembly and configured to magnetically couple to the side surface of the cabinet at least when the expansion assembly is in the second configuration.

16. The laundry hanging apparatus of claim 1 wherein the bracket comprises an opening receiving the post assembly and a bearing plate configured to abut the lower edge of the appliance.

17. A system comprising a household appliance having a cabinet defining an interior with at least a top surface and a side surface, with the side surface having a lower edge that lies above a surface on which the appliance sits, and the laundry hanging apparatus from claim 1.

* * * * *

UNITED STATES PATENT AND TRADEMARK OFFICE

CERTIFICATE OF CORRECTION

PATENT NO. : 8,777,025 B1
APPLICATION NO. : 13/212261
DATED : July 15, 2014
INVENTOR(S) : Thomas H. Buckleitner et al.

It is certified that error appears in the above-identified patent and that said Letters Patent is hereby corrected as shown below:

Title Page Item (75) "Inventors: Thomas H. Buckleitner, Stevensville, MI (US); Jayaprakash Kannappan, Tamil Nadu (IN); Travis M. Perkins, Granger (IN); Arunprasath Sridharan, Tamil Nadu (IN); Daniel E. Teich, Saint Joseph, MI (US)" should read -- Inventors: Thomas H. Buckleitner, Stevensville, MI (US); Jayaprakash Kannappan, Tamil Nadu (IN); Travis M. Perkins, Granger, IN (US); Arunprasath Sridharan, Tamil Nadu (IN); Daniel E. Teich, Saint Joseph, MI (US); Matthew Travis Doll, Stevensville, MI (US) --

Signed and Sealed this
Thirteenth Day of October, 2015

Michelle K. Lee

Michelle K. Lee
*Director of the United States Patent and Trademark Office*